US005763842A

United States Patent [19]

Tsai et al.

[11] Patent Number: 5,763,842

[45] Date of Patent: Jun. 9, 1998

[54] KEY SWITCH ARRANGEMENT FOR NOTEBOOK COMPUTERS

[75] Inventors: Ching-Cheng Tsai, Keelung; Wen-To Chuo; Fu-Jen Hsu, both of Taipei Hsien, all of Taiwan

[73] Assignee: Chicony Electronics Co., Ltd., Taipei Hsien, Taiwan

[21] Appl. No.: 753,045

[22] Filed: Nov. 19, 1996

[51] Int. Cl.[6] ..... H01H 13/70

[52] U.S. Cl. ..... 200/5 A; 200/344

[58] Field of Search ..... 200/5 A, 512–517, 200/341–345; 361/680

[56] References Cited

U.S. PATENT DOCUMENTS 5,278,371 1/1994 Watanabe et al. ..... 200/344
5,512,719 4/1996 Okada et al. ..... 200/344
5,555,971 9/1996 Takada et al. ..... 200/345
5,590,020 12/1996 Sellers ..... 361/680
5,630,501 5/1997 Tsay ..... 200/341 X

*Primary Examiner*—J. R. Scott
*Attorney, Agent, or Firm*—Morton J. Rosenberg; David I. Klein; Jun Y. Lee

[57] ABSTRACT

A key switch for notebook computers, including a bottom frame having two pairs of upright lugs spaced near two opposite sides, a membrane circuit mounted on the bottom frame, a key cap, a rubber cone supported on the membrane circuit and compressed by the key cap to trigger the membrane circuit in producing an electrical signal, a first link having one end pivoted to the key cap and an opposite end coupled to one pair of upright lugs of the bottom frame by a slip joint, and a second link pivotably coupled to the first link in its middle and having one end pivoted to the key cap and an opposite end pivoted to the other pair of upright lugs of the bottom frame.

7 Claims, 9 Drawing Sheets

KEY SWITCH ARRANGEMENT FOR NOTEBOOK COMPUTERS

BACKGROUND OF THE INVENTION

The present invention relates to a key switch for notebook computers, and more particularly to such a key switch which is easy to assemble, and can be smoothly and positively operated.

FIG. 1 shows a key switch for notebook computers according to the prior art. This structure of prior art key switch 10*a* is comprised of a key cap 11*a*, a rubber cone 12*a*, a first link 13*a*, a second link 14*a*, a membrane circuit 15*a*, and a bottom frame 16*a*. The first link 13*a* and the second link 14*a* are pivotably connected into a crossed linkage coupled between the key cap 11*a* and the bottom frame 16*a*. When the key cap 11*a*, is depressed, the rubber cone 12*a*, is compressed to trigger the membrane circuit 15*a*, causing it to produce an electrical signal. On the contrary, when the key cap 11*a* is released from the hand, the rubber cone 12*a*, immediately returns to its former shape, and therefore the membrane circuit 15*a*, is switched off. This structure of key switch is complicated to assemble because a big number of screws shall be used to fix the rubber cone 12*a*, the membrane circuit 15*a*, and the bottom frame 16*a* together. When the key switch is operated, the links 13*a*, 14*a* tend to be forced to vibrate by the sharp edges of the link mounting holes 17*a*, 18*a* of the bottom frame 16*a*. Another drawback of this structure of key switch is that the key cap 11*a* tends to oscillate when it is moved vertically, because the link mounting holes 18*a* to which the first link 13*a* is slidably coupled are oblong holes respectively sloping in one direction. Still another drawback of this structure of key switch is that the key cap 11*a*tends to be damaged when it is forced into engagement with respective pivot pins 19*a*, 20*a* of the links 13*a*, 14*a*. Because the links 13*a*, 14*a* are rigid and not deformable, the pivot pins 19*a*, 20*a* of the links 13*a*, 14*a* cannot be respectively squeezed inwards for coupling to the respective coupling portions of the key cap 11*a* conveniently. Still another drawback of this structure of key switch is that the rubber cone tends to deviate from course when it is compressed, thereby causing a malfunction. Furthermore, when the key switch is operated, heat cannot be quickly carried away.

SUMMARY OF THE INVENTION

The present invention has been accomplished to provide a key switch for notebook computers which eliminates the aforesaid drawbacks. According to one aspect of the present invention, the key switch is comprised of a bottom frame, a key cap, a membrane circuit supported on the bottom frame, a rubber cone supported on the membrane circuit, a first link and a second link pivotably connected together and coupled between the key cap and the bottom frame to guide the movement of the key cap vertically, wherein the first link and the second link have respective smoothly curved raised portions movably disposed in contact with the flat base of the rubber cone. According to another aspect of the present invention, the first link has a pair of pivot pins pivotably coupled to pivot holes in respective upright lugs of the bottom frame, the second link has a pair of pivot pins slidably coupled to horizontal oblong holes in respective upright lugs of the bottom frame. According to still another aspect of the present invention, the pivot holes and oblong holes of the respective upright lugs of the bottom frame have a respective smoothly curved end edge so that the pivot pins of the first link and second link can be smoothly turned in the respective pivot holes or moved in the respective oblong holes. According to still another aspect of the present invention, the first link is comprised of two parallel frame rods, and an arched springy connecting rod connected between the parallel frame rods that can be deformed, for permitting the respective pivot pins of first link to be respectively coupled to respective downward hooks of the key cap. According to still another aspect of the present invention, the second link is comprised of two parallel frame rods, and a transverse connecting rod connected between the parallel frame rods, wherein the transverse connecting rod has an arched springy section in the middle, that can be deformed, for permitting the respective pivot pins of the second link to be coupled to respective axle housings of the key cap. According to still another aspect of the present invention, the rubber cone has bottom ventilation grooves and through holes, the bottom frame has through holes, and the membrane circuit has punch holes respectively provided for dissipation of heat quickly.

DETAILED DESCRIPTION OF THE PREFERRED EMBODIMENT

Figure 1:
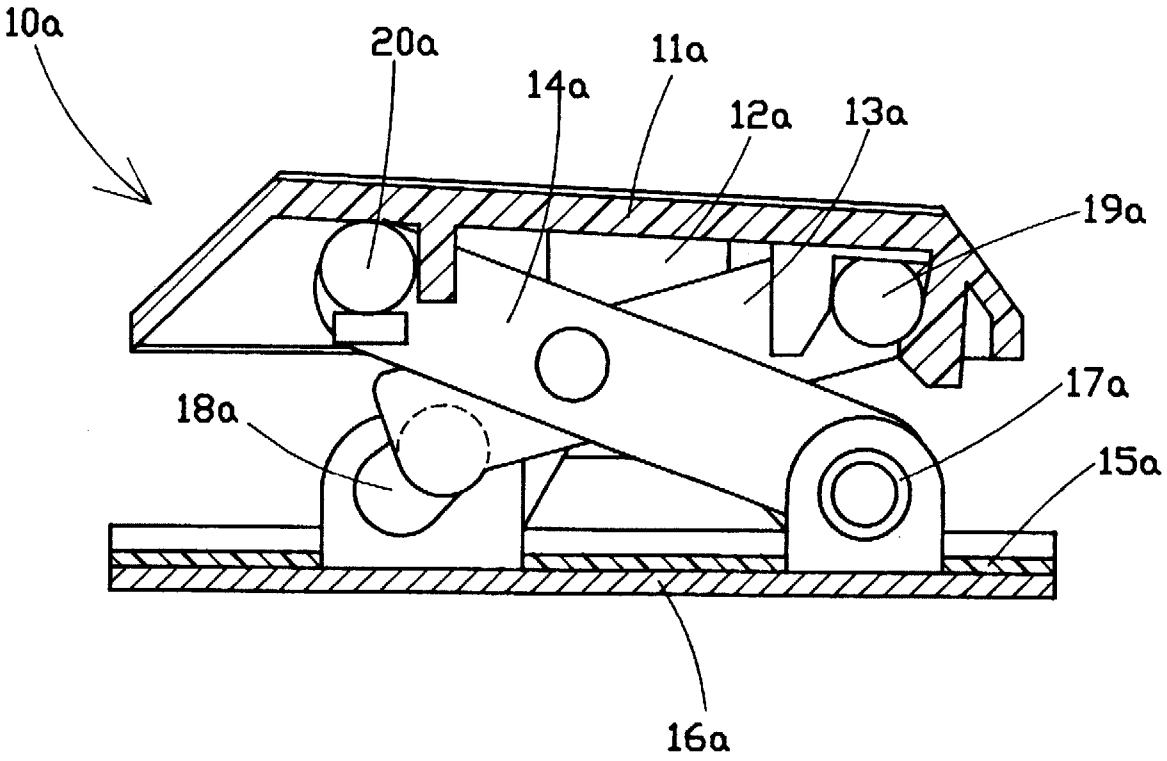
FIG.1 (PRIOR ART)
FIG. 1 is a side plain view of a key switch for notebook computers according to the prior art.
Figure 2:
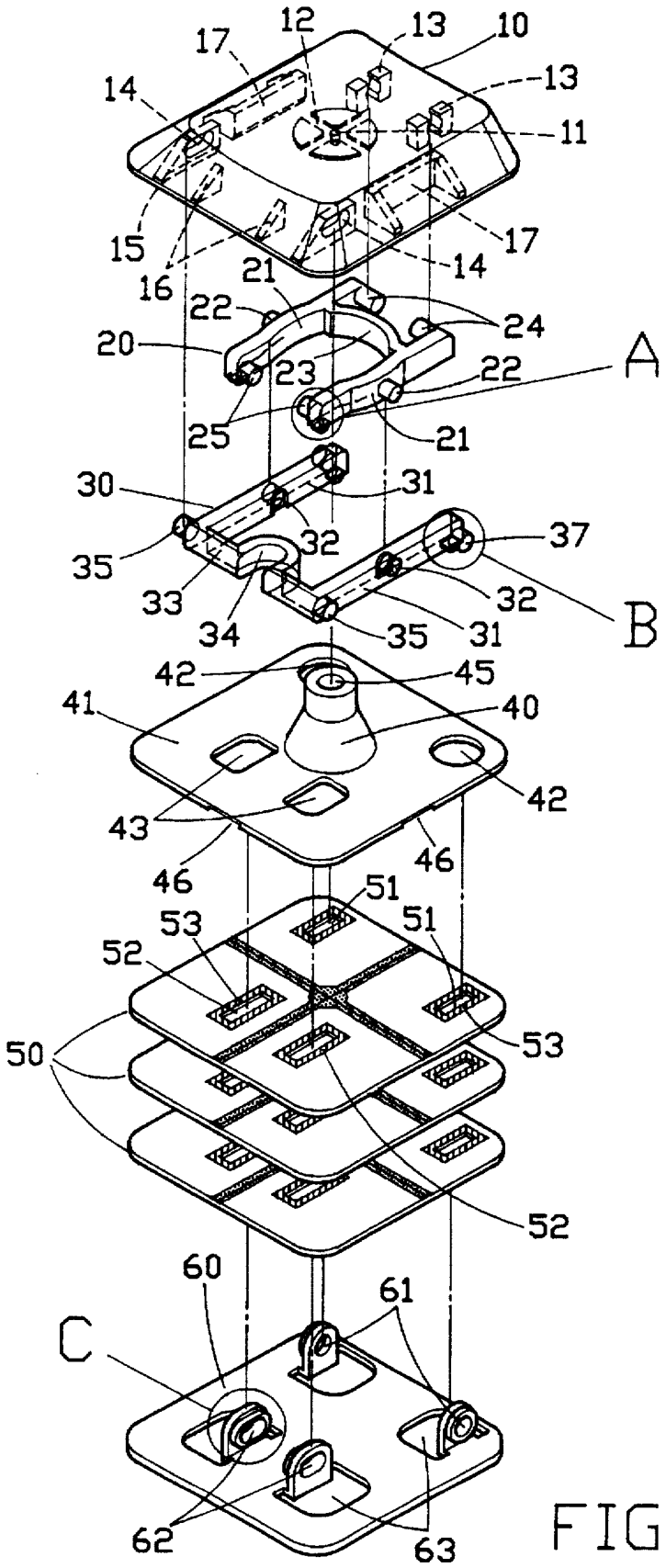
FIG. 2 is an exploded view of a key switch for notebook computers according to the present invention.
Figure 2B:
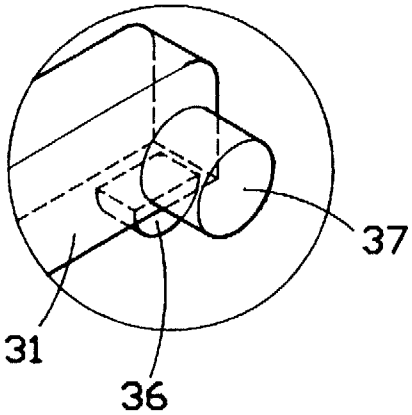
FIG. 2B is an enlarged view of part B of FIG. 2.
Figure 2C:
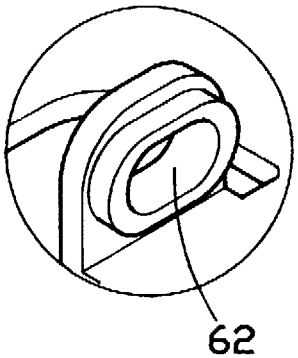
FIG. 2C is an enlarged view of part C of FIG. 2.
Figure 2A:
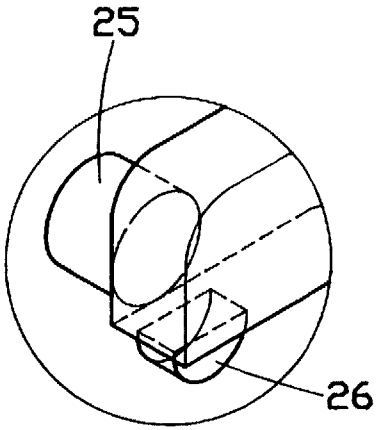
FIG. 2A is an enlarged view of part A of FIG. 2.
Figure 3:
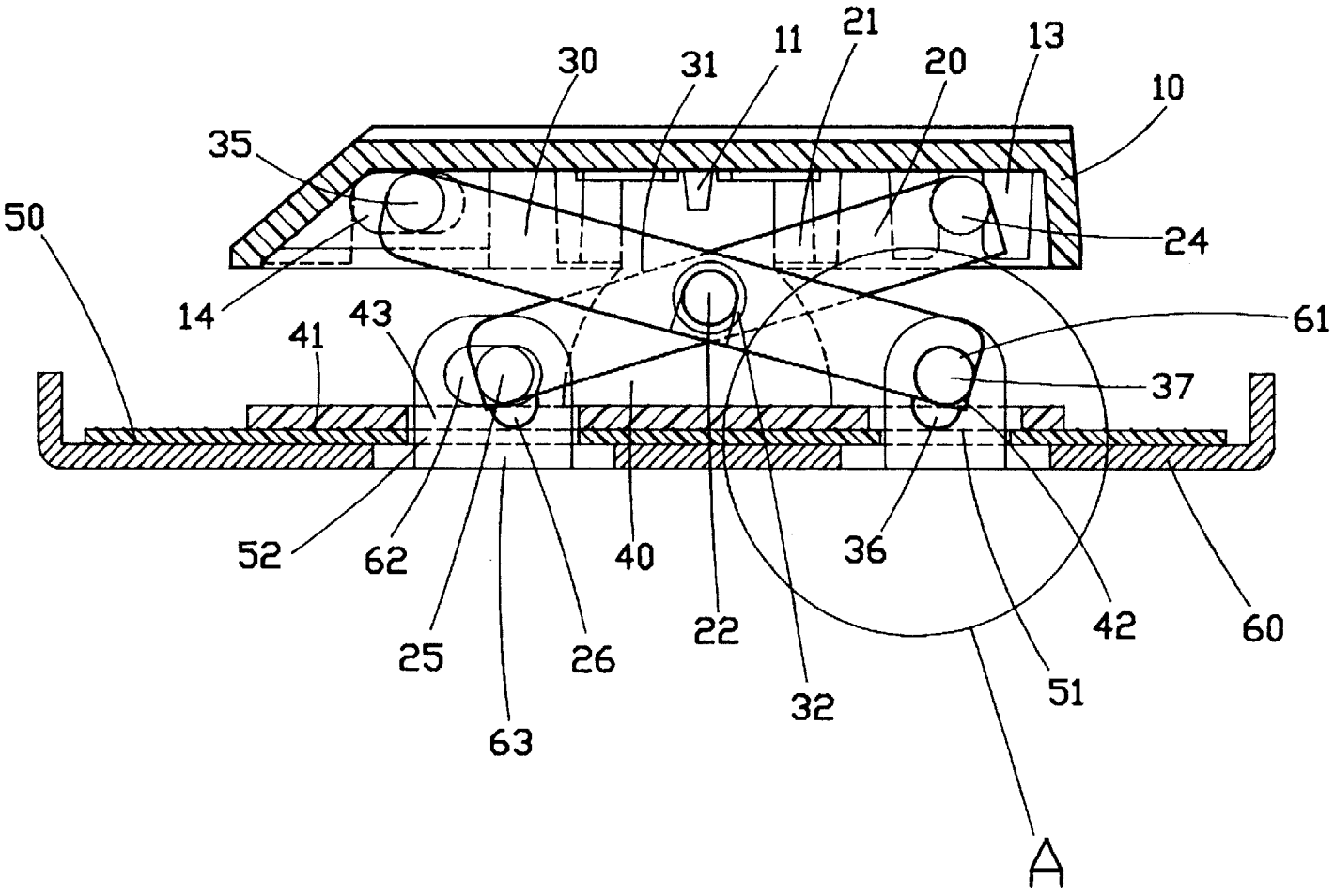
FIG. 3 is a side plain view of the key switch according to the present invention.
Figure 3A:
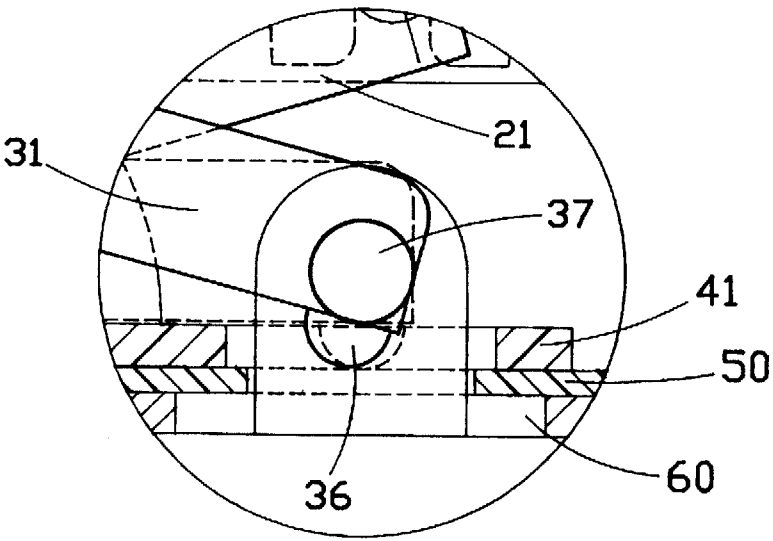
FIG. 3A is an enlarged view of part A of FIG. 3.
Figure 4:
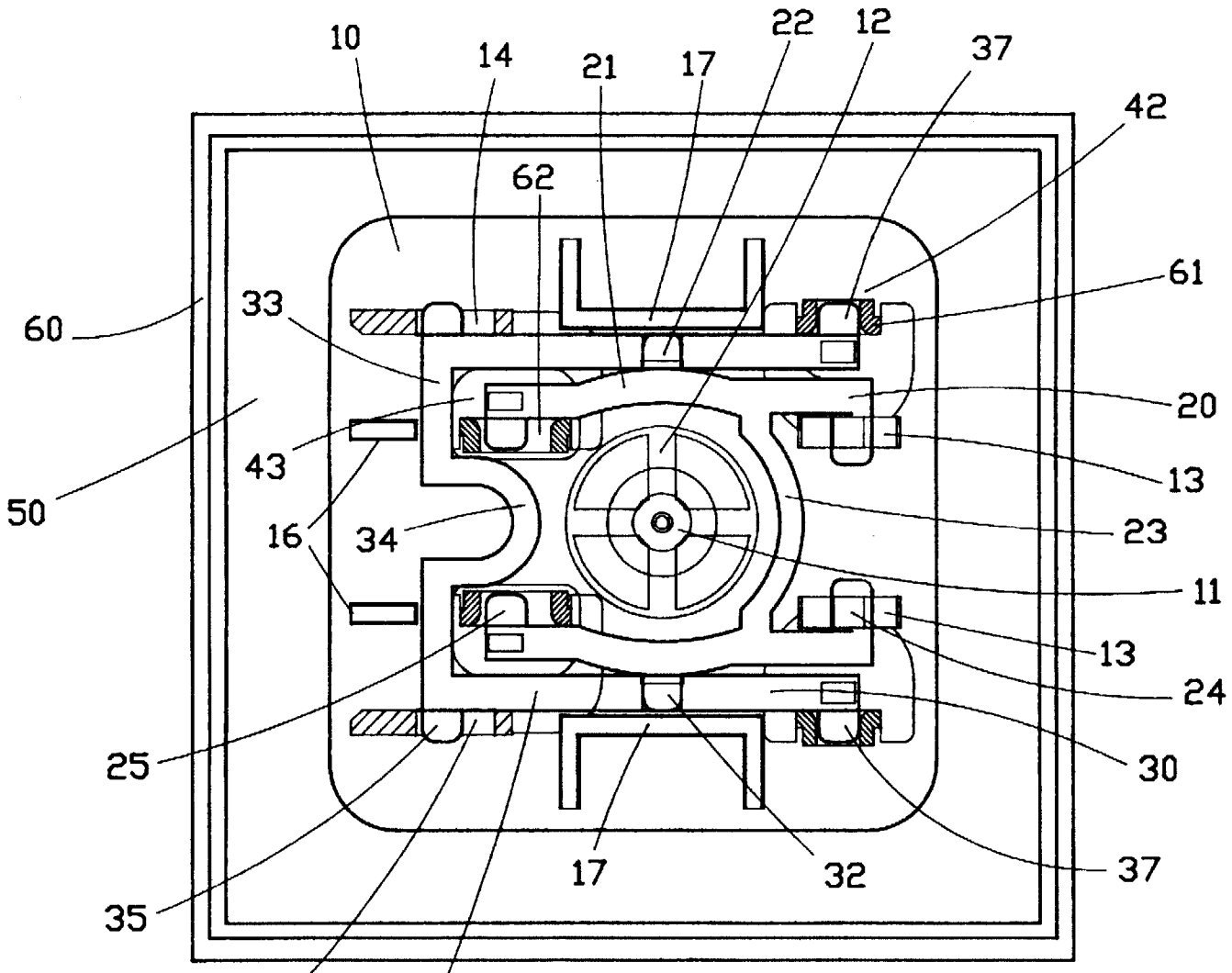
FIG. 4 is a top plain view in an enlarged scale of the key switch according to the present invention.

Referring to Figures from 2 to 5, a key switch in accordance with the present invention is generally comprised of a key cap 10, a first link 20, a second link 30, a rubber cone 40, a membrane circuit 50, and a bottom frame 60.

The key cap 10 has a substantially rectangular shape, a downward plunger 11 perpendicularly downwardly raised from the center at the bottom, a plurality of radial ventilation grooves 12 disposed at the bottom and spaced around the plunger 11, two symmetrical pairs of downward hooks 13 bilaterally raised from the bottom and disposed adjacent to one side, two symmetrical axle housings 14 bilaterally raised from the bottom and disposed adjacent to one side remote from the downward hooks 13 and having a respective bevel bottom edge 15, two first guide grooves 16 disposed at the bottom adjacent to one side and spaced between the axle housings 14, and two second guide grooves 17 symmetrically disposed at the bottom near two opposite sides and spaced between the downward hooks 13 and the axle housings 14.

The first link 20 is coupled to the key cap 10 at the bottom, comprising two parallel frame rods 21 and an arched springy connecting rod 23 connected between the parallel frame rods 21 in the middle. Each of the parallel frame rods 21 comprises a first pivot pin 24 perpendicularly inwardly raised from one end, a second pivot pin 25 perpendicularly inwardly raised from an opposite end, a third pivot pin 22 perpendicularly outwardly raised from the middle, and a smoothly curved raised portion 26 at the bottom adjacent to the second pivot pin 25.

The second link 30 is coupled to the key cap 10 at the bottom, comprising two parallel frame rods 31, and a transverse connecting rod 33 connected between the parallel frame rods 31 at one end. The transverse connecting rod 33 has an arched springy section 34 in the middle, and two pivot pins 35 longitudinally extended from two opposite ends. Each of the frame rods 31 has a pivot hole 32 in the middle, a pivot pin 37 raised from one end at an outer side remote from the transverse connecting rod 33, and a smoothly curved raised portion 36 disposed at the bottom near the pivot pins 37.

The rubber cone 40 is disposed below the first link 20 and the second link 30 at the bottom, having a recessed top hole 45 adapted for receiving the plunger 11 of the key cap 10, a downward triggering rod 44 suspended from the bottom below the recessed top hole 45 and spaced above the center hole 47 (Shown in FIGS. 6 and 7) at the center the flat base 41 of the rubber cone 40, a plurality of through holes 42, 43 through the flat base 41 for ventilation, and a plurality of ventilation grooves 46 at the bottom of the flat base 41.

The membrane circuit 50 is a multi-layer membrane circuit supported between the bottom frame 60 and the rubber cone 40, having a plurality of punch holes 51, 52 peripherally sealed with a bonding resin 53.

Figure 5:
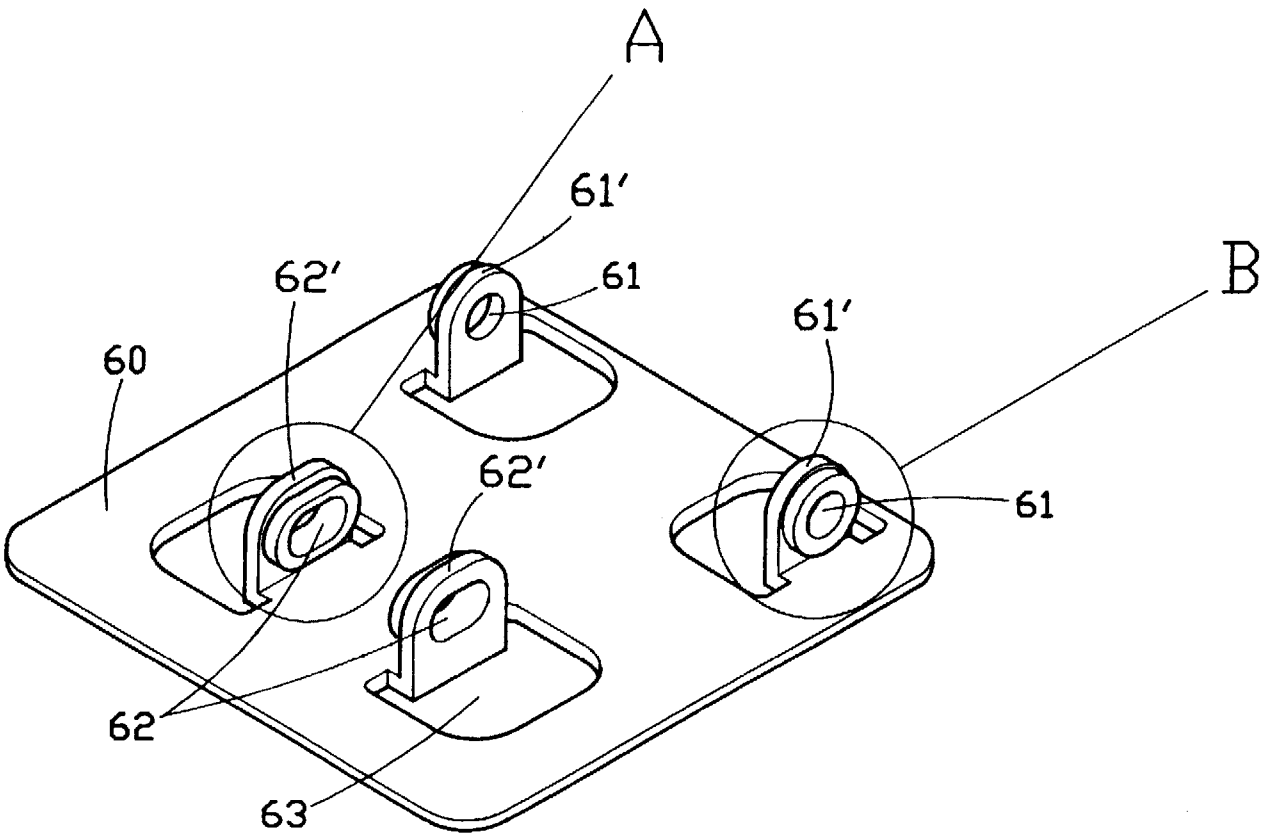
FIG. 5 is an elevational view in an enlarged scale of the bottom frame of the key switch shown in FIG. 2.
Figure 5B:
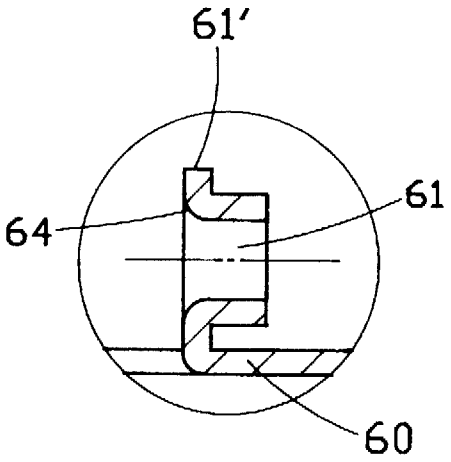
FIG. 5B is an enlarged view of part B of FIG. 5.
Figure 5A:
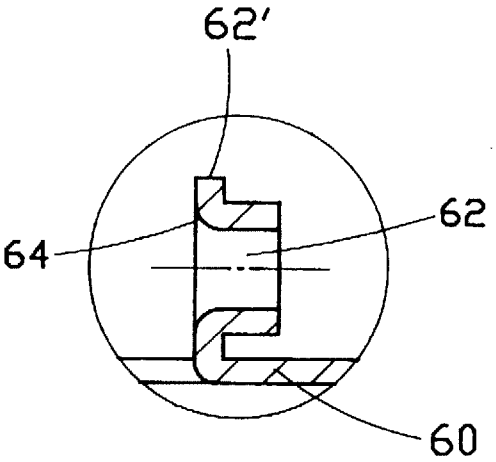
FIG. 5A is an enlarged view of part A of FIG. 5.

The bottom frame 60 supports the membrane circuit 50, comprising two first upright lugs 61' which define a respective axle hole 61 adapted for coupling the second link 30, two second upright lugs 62' which define a respective horizontal oblong hole 62 adapted for coupling the first link 20, and a plurality of vertical through holes 63 for ventilation. Each of the upright lugs 61', 62' has a smoothly curved edge 64 at one end (see FIGS. 5A and 5B) of the respective hole 61, 62.

The assembly process of the key switch is outlined hereinafter with reference to Figures from 2 to 5 again. The membrane circuit 50 and the rubber cone 40 are mounted on the bottom frame 60 at the top in proper order, permitting the upright lugs 61', 62' to be inserted through the punch holes 51, 52 of the membrane circuit 5 and the through holes 42, 43 of the flat base 41 of the rubber cone 40, then the pivot pins 37 of the frame rods 31 of the second link 20 are respectively inserted into the axle holes 61 of the first upright lugs 61' of the bottom frame 6 and the second pivot pins 25 of the first link 20 are respectively inserted into the oblong holes 62 of the second upright lugs 62', and then the third pivot pins 22 of the first link 20 are respectively inserted into the pivot holes 32 of the second link 30 for permitting the links 20, 30 to be turned relative to each other, and then the key cap 10 is coupled to the links 20, 30 by coupling the downward hooks 13 and axle housings 14 of the key cap 10 to the first pivot pins 24 of the first link 20 and the pivot pins 35 of the transverse connecting rod 33 of the second link 30.

Figure 6:
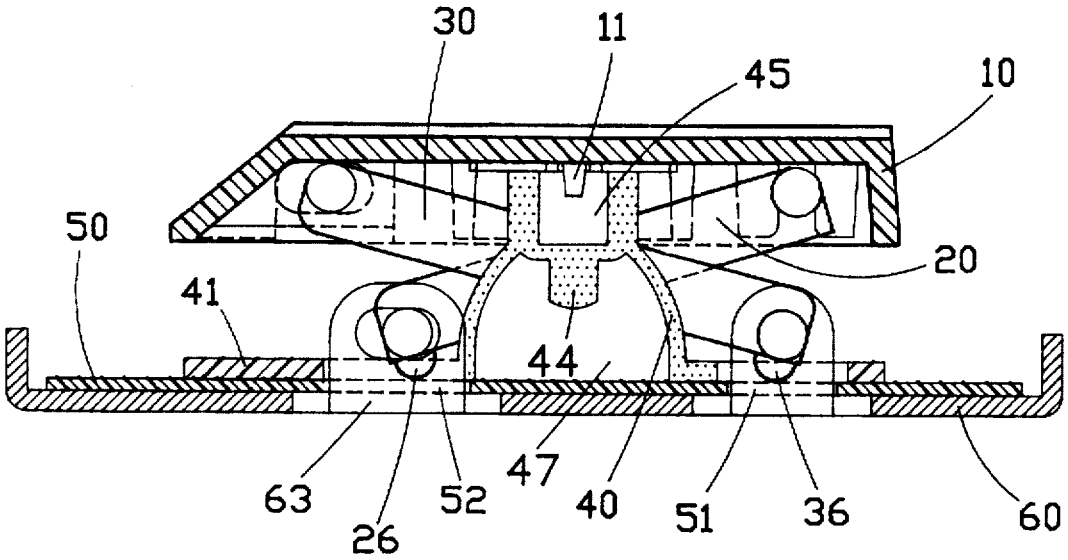
FIG. 6 is a sectional side view of the key switch according to the present invention; and, FIG. 7 is similar to FIG. 6 but showing the key cap depressed.
Figure 7:
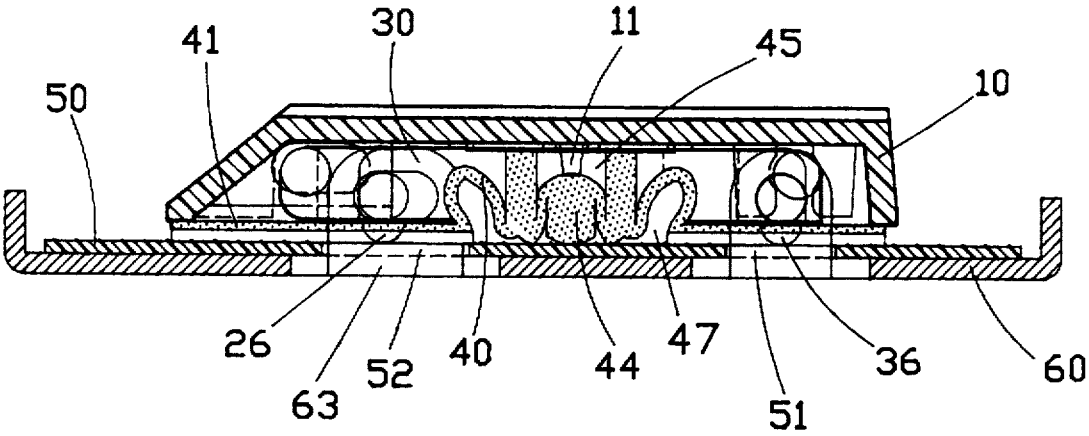

Referring to FIGS. 6 and 7, when the key cap 10 is depressed, the links 20, 30 are turned relative to each other to guide the downward movement of the key cap 10 smoothly, and at the same time the downward triggering rod 44 of the rubber cone 40 is forced by the plunger 11 of the key cap 10 to trigger the membrane circuit 50, and therefore the key switch is switched on (see FIG. 7). When the key cap 10 is released from the hand, the rubber cone 40 immediately returns to its former shape, thereby causing the links 20, 30 to be turned relative each other reversely, and therefore the key cap 10 is returned to its former position. When the rubber cone 40 returns to its former shape, the triggering rod 44 of the rubber cone 40 is disconnected from the membrane circuit 50, and therefore the key switch is switched off (see FIG. 6). When the first link 20 and the second link 30 are respectively turned downward or upward, the smoothly curved raised portions 26, 36 are moved over the top side of the flat base 41 of the rubber cone 40, therefore the first link 20 and the second link 30 can be smoothly moved relative to the flat base 41 of the rubber cone 40.

Referring to Figures from 2 to 7 again, because the upright lugs 61', 62' have a respective smoothly curved edge 64 at one end of the respective hole 61, 62, the links 20, 30 can be smoothly turned relative to the upright lugs 61', 62'. Because pivot pins 37 of the frame rods 31 of the second link 30 are respectively turned in the pivot holes 61 of the first upright lugs 61' of the bottom frame 60 and the second pivot pins 25 of the first link 20 are slidably mounted in the oblong holes 62 of the second upright lugs 62', the key cap 10 can be guided by the links 20, 30 up and clown smoothly. The aforesaid guide grooves 16, 17 of the key cap 10 are adapted for guiding the key cap 10 into coupling with the links 20, 30. Because the frame rods 21 of the first link 20 are connected in parallel by the arched springy connecting rod 23, the link 20 can be deformed, for permitting the first pivot pins 24 to be respectively coupled to the downward hooks 13 of the key cap 10. When the key cap 10 is operated, the arched springy connecting rod 23 absorb shock waves. The arched springy section 34 of the transverse connecting rod 33 of the second link 30 enables the transverse connecting rod 33 to be deformed, so that the pivot pins 35 can be conveniently coupled to the axle housings 14 of the key cap 10. The arched springy section 34 can also absorb shocks when the key cap 10 is operated. Furthermore, because the plunger 11 of the key cap 10 is inserted into the recessed top hole 45 of the rubber cone 40, the downward pressure of the key cap 10 can be positively transmitted to the downward triggering rod 44 of the rubber cone 40, causing it to trigger the membrane circuit 50. The design of the ventilation grooves 12 of the key cap 10 prevents the key cap 10 from being adhered to the rubber cone 40. The design of the holes 42, 43 in the flat base 41 of the rubber cone 40 and the holes 63 in the bottom frame 60 enables heat to be quickly carried away from the key switch.

It is to be understood that the drawings are designed for purposes of illustration only, and are not intended as a definition of the limits and scope of the invention disclosed.

What the invention claimed is:

1. A key switch for a notebook computer, comprising:

a key cap, said key cap comprising a bottom side, a downward plunger perpendicularly and downwardly raised from the bottom side at a central position, a plurality of radial ventilation grooves disposed at the bottom side and spaced around said plunger, two symmetrical pairs of downwardly directed hooks and two symmetrical axle housings bilaterally raised from the bottom side;

a bottom frame, said bottom frame comprising two first upright lugs which define a respective axle hole, two second upright lugs which define a respective horizontal oblong hole, and a plurality of vertical through holes respectively disposed around said first upright lugs and said second upright lugs;

a membrane circuit supported on said bottom frame, said membrane circuit having a plurality of punch holes through which the first upright lugs and second upright lugs of said bottom frame pass;

a rubber cone mounted on said membrane circuit for pressing by the plunger of said key cap to trigger said membrane circuit in producing an electrical signal, said rubber cone comprising a flat base having a center hole, and a plurality of through holes through which the first upright lugs and second upright lugs of said bottom frame pass, a cone body raised from the periphery of the center hole of said flat base and having a downwardly directed trigger rod suspended from an inside surface spaced above the center hole of said flat base;

a first link coupled between said key cap and said bottom frame, said first link comprising two parallel frame rods and an arched springy connecting rod connected between the parallel frame rods of said first link, each of the parallel frame rods of said first link comprising a first pivot pin at one end pivoted to one pair of said downwardly directed hooks of said key cap, a second pivot pin at an opposite end sliding in the oblong hole of one second upright lug of said bottom frame, a third pivot pin spaced between said first pivot pin and said second pivot pin, and a smoothly curved raised portion disposed adjacent to said second pivot pin and in contact with the flat base of said rubber cone; and, a second link pivoted to said first link and coupled between said key cap and said bottom frame, said second link comprising two parallel frame rods, and a transverse connecting rod connected between the parallel frame rods of said second link at one end, the transverse connecting rod of said second link having an arched springy section in a middle portion thereof, and two pivot pins longitudinally aligned at two opposite ends and respectively pivoted to the axle housings of said key cap, each of the frame rods of said second link having (a) a pivot hole in a middle portion thereof for receiving the second pivot pin of one frame rod of said first link therein, (b) a pivot pin raised from one end and revolvably inserted into the axle hole of one upright lug of said bottom frame, and (c) a smoothly curved raised portion disposed at a bottom side of said frame rod and in contact with the flat base of said rubber cone.

2. The key switch of claim 1 wherein the axle housings of said key cap have a respective bevel bottom edge.

3. The key switch of claim 1 wherein the cone body of said rubber cone has a recessed top hole which receives the downward plunger of said key cap.

4. The key switch of claim 1 wherein the flat base of said rubber cone has a plurality of ventilation grooves at a bottom side respectively extended from the center hole of said flat base and facing said membrane circuit.

5. The key switch of claim 1 wherein the punch holes of said membrane circuit are respectively peripherally sealed with a bonding resin.

6. The key switch of claim 1 wherein the axle holes and oblong holes of the first upright lugs and second upright lugs of said bottom frame have a respective smoothly curved end edge.

7. The key switch of claim 1 wherein said key cap has a plurality of guide grooves at the bottom side for guiding said key cap into coupling engagement with said first link and said second link.

* * * * *